US007591877B2

(12) United States Patent
Matsuda

(10) Patent No.: US 7,591,877 B2
(45) Date of Patent: Sep. 22, 2009

(54) MANUFACTURING METHOD OF BRIQUETTE FOR USE AS METAL STOCK

(75) Inventor: Mitsuma Matsuda, Kagawa (JP)

(73) Assignee: JTEKT Corporation, Osaka (JP)

( * ) Notice: Subject to any disclaimer, the term of this patent is extended or adjusted under 35 U.S.C. 154(b) by 561 days.

(21) Appl. No.: 11/578,296

(22) PCT Filed: Apr. 15, 2005

(86) PCT No.: PCT/JP2005/007311

§ 371 (c)(1),
(2), (4) Date: Oct. 13, 2006

(87) PCT Pub. No.: WO2005/100619

PCT Pub. Date: Oct. 27, 2005

(65) Prior Publication Data

US 2007/0209482 A1 Sep. 13, 2007

(30) Foreign Application Priority Data

Apr. 15, 2004 (JP) ..... 2004-120122

(51) Int. Cl.
*C22B 1/248* (2006.01)
*B22F 8/00* (2006.01)

(52) U.S. Cl. ..... 75/770; 75/771; 75/773

(58) Field of Classification Search ..... 75/316–322, 75/765–768, 770–773; 419/2, 27, 29
See application file for complete search history.

(56) References Cited

U.S. PATENT DOCUMENTS 2,376,706 A 5/1945 Lum
2002/0152843 A1* 10/2002 Ishihara et al. ..... 75/316
2003/0075014 A1* 4/2003 Ishihara et al. ..... 75/232
2008/0000328 A1* 1/2008 Matsuda et al. ..... 75/770

FOREIGN PATENT DOCUMENTS

| | | | |
|---|---|---|---|
| JP | 1-108321 | A | 4/1989 |
| JP | 2000-119760 | A | 4/2000 |
| JP | 2000-212653 | A | 8/2000 |
| JP | 2001-089818 | A | 4/2001 |
| JP | 2002-241854 | A | 8/2002 |
| SU | 530908 | A1 | 10/1976 |
| WO | WO 03/064709 | A1 | 8/2003 |

OTHER PUBLICATIONS

International Search Report of PCT/JP2005/007311, date of mailing May 24, 2005.
European Search Report dated Sep. 29, 2008, issued in corresponding European Patent Application No. 05730600.3.

* cited by examiner

*Primary Examiner*—George Wyszomierski
*Assistant Examiner*—Mark L Shevin
(74) *Attorney, Agent, or Firm*—Westerman, Hattori, Daniels & Adrian, LLP.

(57) ABSTRACT

A manufacturing method of briquette for use as metal stock is provided which is adapted for effective reduction of a drying time of a porous mass such that the quantity of energy required for the drying process may be reduced. A porous mass is formed by compressing cotton-like aggregates containing metal grinding dust under pressure. The resultant porous mass is immediately dipped in a heated solidification assistant. Subsequently, the porous mass impregnated with the solidification assistant is immediately transported to a drying furnace for drying.

5 Claims, 3 Drawing Sheets

MANUFACTURING METHOD OF BRIQUETTE FOR USE AS METAL STOCK

TECHNICAL FIELD

The present invention relates to a manufacturing method of briquette for use as metal stock. Particularly, the invention relates to a method of forming a briquette from a recyclable material containing a powder metal such as grinding dust.

BACKGROUND ART

Grinding dust resulting from grinding a ferrous metal such as bearing steel, carburized steel and the like are collected in the form of cotton-like (fibrous) aggregates including: a grinding fluid containing water and oil; abrasive grains and the like. Since the cotton-like aggregates contains a large quantity of pure iron, there have been suggested a technique for reusing the aggregates as a steelmaking material. Japanese Unexamined Patent Publication No. 2001-241026, for example, discloses a technique of forming a briquette for use as steelmaking material. The briquette is formed by the steps of: forming a porous mass (a brittle compact) by compression molding the cotton-like aggregates with a press, the aggregates having adjusted contents of water and oil; impregnating an aqueous solution of solidification assistant into the porous mass by dipping the porous mass in the solution; and subjecting the porous mass to natural seasoning (curing).

The above manufacture of the briquette for use as steelmaking material requires a substantial length of drying time because the porous mass is naturally seasoned. In this connection, an attempt has been made to quickly dry the mass using a drying furnace. Unfortunately, however, the porous masses formed by compression molding are significantly varied in bulk density. When the masses are dipped in the aqueous solution of solidification assistant, therefore, the amount of water impregnated into the porous masses is also varied greatly. If the bulk density of the porous mass varies in the range of 1.5 to 3.5, for example, the water content of the porous mass impregnated with the solidification assistant varies in the range of 20 to 200 cc. Therefore, when the porous masses are dried by means of the drying furnace, it is required to set the drying time according to a porous mass having the greatest moisture content.

The just-molded porous mass is increased in temperature by 30 to 50° C. due to the compression molding. If the porous mass is immediately dipped in the solidification assistant, the temperature of the porous mass is lowered by 20 to 30° C. because the solidification assistant is at or slightly lower than normal temperatures. Accordingly, the subsequent drying step takes much time and energy to heat the porous mass to the initial temperature.

Hence, the attempt to shorten the drying time of the porous mass by using the drying furnace encounters a problem that the drying time is not effectively shortened while a large quantity of energy is consumed for drying.

In view of the foregoing, the invention has been accomplished and has an object to provide a manufacturing method of briquette for use as metal stock which is adapted for an effective reduction of the drying time of the porous mass such as to save energy for drying.

DISCLOSURE OF THE INVENTION

According to the invention for achieving the above object, a manufacturing method of briquette for use as metal stock comprises: a molding step of forming a porous mass by compression molding a recyclable material containing a powder metal; an impregnating step of impregnating the just-molded porous mass with a solidification assistant by dipping the porous mass in the solidification assistant having a higher temperature than the porous mass; and a drying step of drying the just-impregnated porous mass by heating the porous mass in a drying furnace.

According to the briquette manufacturing method of this constitution, the porous mass may be raised in temperature as being impregnated with the solidification assistant, because the just-molded porous mass is dipped in the solidification assistant having the higher temperature than the porous mass. This permits the subsequent drying step to quickly raise the temperature of the porous mass to a desired drying temperature.

In the impregnating step, the porous mass may preferably be dipped in the solidification assistant for 15 to 180 seconds. In this case, the amount of solidification assistant impregnated into the porous mass is reduced because of the short impregnating time. This leads to the reduction of water content of the porous mass. Accordingly, the drying time of the porous mass may be further reduced.

The above briquette manufacturing method may further comprise a preheating step of heating the porous mass, which is interposed between the impregnating step and the drying step. In this case, as well, the drying time of the porous mass may be further reduced.

According to the briquette manufacturing method, heat including waste heat generated in the drying furnace may preferably be supplied to the porous mass carried on a transport path extended from the molding step to the drying step. In this case, the heat including the waste heat may be used to keep the heat in the porous mass on the transport path or to heat the porous mass.

The solidification assistant may preferably be heated to 80 to 100° C. This permits the porous mass to be heated to an even higher temperature so that the porous mass may be dried more quickly.

The solidification assistant may be at least one selected from the group consisting of colloidal silica, sodium silicate, aluminum phosphate and asphalt emulsion. This provides for the formation of a briquette having a high mechanical strength and featuring easy handlings such as transportation and storage.

The recyclable material may be at least one selected from the group consisting of cotton-like aggregates containing ferrous-metal grinding dust and a grinding fluid, shot waste including a ferrous powder metal and a large number of shot beads, and powder dust. In this case, the materials conventionally committed to landfill disposal as industrial waste may be put to effective reuse.

The manufacturing method of briquette for use as metal stock according to the invention is adapted for the effective reduction of drying time of the porous mass such that the quantity of energy required for the drying process may be reduced.

BEST MODES FOR CARRYING OUT THE INVENTION

The embodiments of the invention will be described hereinbelow with reference to the accompanying drawings.

Figure 1:
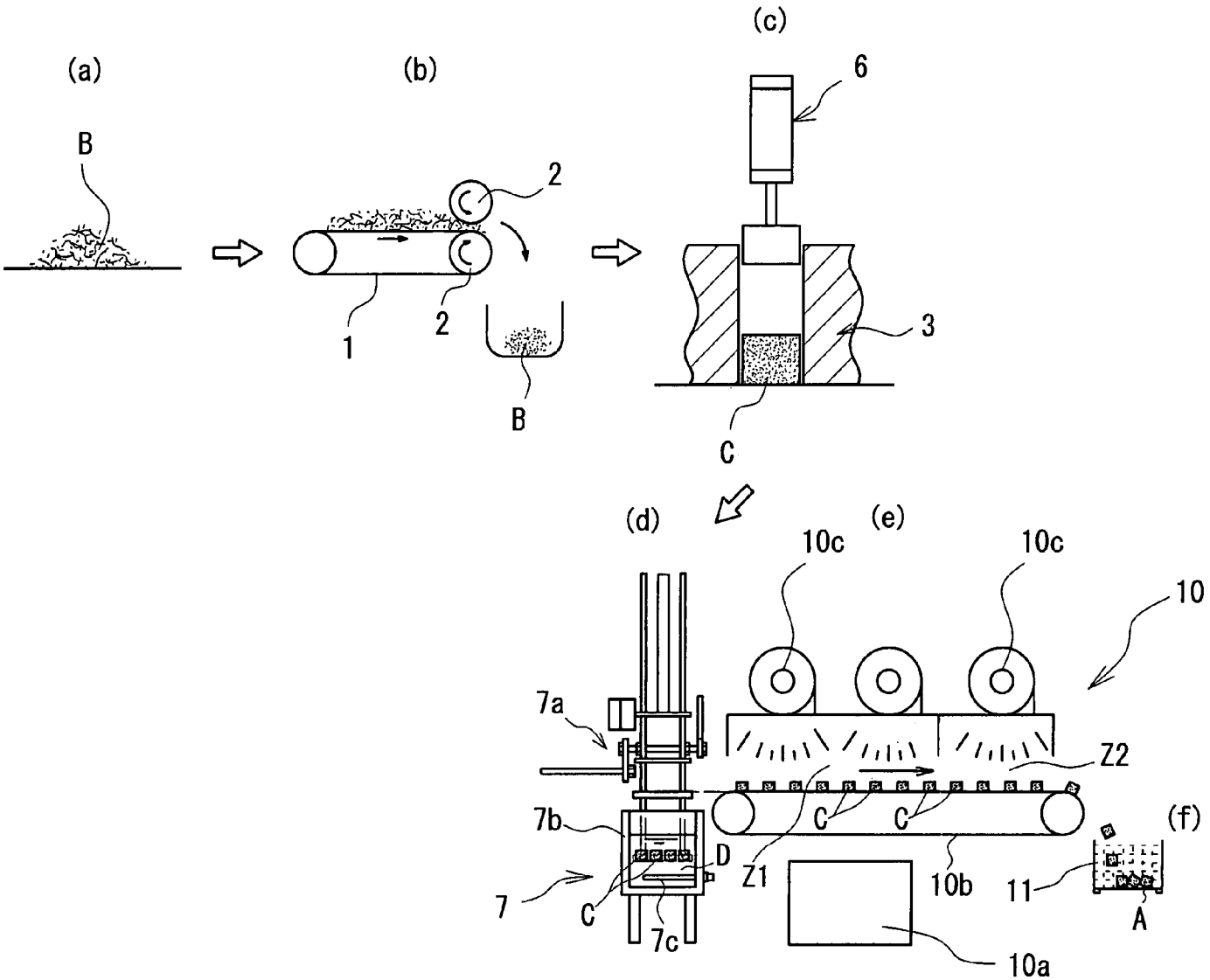
FIG. 1 is a step chart illustrating a manufacturing method of briquette for use as metal stock according to one embodiment of the invention.

FIG. 1 is a step chart illustrating a manufacturing method of briquette for use as metal stock according to one embodiment of the invention. The manufacturing method of a briquette A is carried out as follows. First, cotton-like aggregates B (FIG. 1A) of grinding dust resulting from a grinding process of a ferrous metal hardened by heating is compressed under pressure for preliminary adjustment of the contents of water and oil which are components of a grinding fluid contained in the cotton-like aggregates B. The compaction of the cotton-like aggregates B may be accomplished, for example, by clamping the aggregates between a pair of rollers 2 as carrying the aggregates on a belt conveyor 1 (FIG. 1B).

Next, a press 6 is operated for compression molding in a mold 3 the cotton-like aggregates B having the adjusted water and oil contents, thereby forming a porous mass C (brittle compact) having a bulk density of 1.5 to 3.5 (molding step: FIG. 1C). The compression molding roughly shears the grinding dust having a spiral-fiber shape and contained in the cotton-like aggregates B, and also removes excessive water and oil from the aggregates B. In addition, the compression molding causes the porous mass C to be increased in temperature by 30 to 50° C. from the pre-molding temperature of the cotton-like aggregates B.

The porous mass C is molded into a shape easy to handle, such as circular cylinder, sphere, prism or the like, and is compacted to such a strength as not to collapse during transportation to the subsequent step.

Immediately after the completion of the molding step, the porous mass C is impregnated with a solidification assistant D (impregnating step: FIG. 1D). The impregnation of the solidification assistant D is performed, for example, by means of a dipping machine 7 which includes a transporting mechanism 7*a* and a tank 7*b* storing therein the solidification assistant D. The transporting mechanism 7*a* operates to receive the porous mass C discharged from the press 6, to carry down the porous mass so as to dip the porous mass in the solidification assistant D in the tank 7*b* for a predetermined period of time, and to carry upward the porous mass for feeding the porous mass to a drying furnace 10 to be described hereinlater.

A heater 7*c* is disposed in the tank 7*a* so that the solidification assistant D is heated by the heater 7*c* to temperatures higher than that of the just-molded porous mass C. Specifically, the solidification assistant is heated to 80 to 90° C. The porous mass C is dipped in the solidification assistant D for 15 to 180 seconds. The dipping time is much shorter than a conventional dipping time (15 minutes or more). Thus, the amount of solidification assistant D impregnated into the porous mass C is reduced whereby the water content of the porous mass C is reduced.

The solidification assistant D may preferably be at least one selected from the group consisting of colloidal silica, sodium silicate, aluminum phosphate and asphalt emulsion. This provides for an easy and rigid solidification of the porous mass C.

Next, the porous mass C finished with the impregnating step is immediately transported to the drying furnace 10 by means of the transporting mechanism 7*a* so as to be dried (drying step: FIG. 1E). This drying furnace 10 is a continuous heating furnace which includes a gas burner 10*a*, a mesh conveyor 10*b*, a blower 10*c* and the like. An interior of the drying furnace 10 is divided into a first heating zone Z1 on a work-piece inlet side, and a second heating zone Z2 on a work-piece outlet side. The first heating zone Z1 has an ambient temperature set to 130° C. to 170° C. for example, whereas the second heating zone Z2 has an ambient temperature set to 100° C. to 120° C. for example.

The drying furnace 10 has a work-piece inlet opened toward the dipping machine 7 so that heat including waste or radiant heat from the drying furnace 10 may be supplied to the porous mass C on a transport path extended from the molding step to the drying step for allowing the porous mass to keep the heat therein or for heating the porous mass. Incidentally, the transport path may be covered by a heat insulating material if it is necessary.

The porous mass C dried in the aforementioned manner is carried on the mesh conveyor 10*b* to be passed through a work-piece outlet and to be discharged into a product collecting box 11 (FIG. 1F). Thus is obtained the briquette A for use as steelmaking material.

According to the briquette manufacturing method of this constitution, the just-molded porous mass C is dipped in the solidification assistant D heated to 80 to 100° C., before the porous mass C is heated. Subsequently, the heated porous mass C is quickly subjected to the drying step. This permits the drying step to quickly heat the porous mass C to a desired drying temperature, so that the drying time may be reduced effectively. In a case where a porous mass C having a diameter of 60 to 70 mm and a length of 40 to 50 mm is dipped in the solidification assistant D at normal temperatures, for example, the porous mass normally requires a drying time of 8 to 16 hours. According to the manufacturing method of the invention, a drying time of 1 to 4 hours is long enough. Thus is achieved a notable reduction of energy used for the drying.

Furthermore, the porous mass C is dipped in the solidification assistant D for a decreased period of time such as to reduce the water content of the porous mass C. In addition, the heat including the waste heat generated in the drying furnace 10 is used for keeping the heat in the porous mass C or heating the porous mass C on the transport path extended from the molding step to the drying step. Hence, the drying time of the porous mass C may be more effectively reduced.

Table 1 lists the evaluation results of the dryness of the porous mass in respect of the case where the manufacturing method of the invention is applied to the manufacture of a briquette for use as steelmaking material. The evaluation test was conducted under the following conditions:

1. Solidification assistant: aqueous solution of sodium silicate (stock solution: water=1:2) at 95° C., 2. Intra-furnace temperature: 120 to 130° C., 3. Porous mass: diameter 66 mm×length 40 mm, 4. Solidification-assistant impregnating time: 30 seconds.

The briquette for use as steelmaking material is generally required of a water content of 3 wt % or less. The measurement of the water content was taken at the center of the briquette.

TABLE 1

| | | DRYING TIME | | | | | | | |
|---|---|---|---|---|---|---|---|---|---|
| | | 30 min | | 40 min | | 50 min | | 60 min | |
| | | SAMPLE No. | | | | | | | |
| | | ① | ② | ① | ② | ① | ② | ① | ② |
| WEIGHT | PRE-IMPREGNATION (g) | 390 | 348 | 348 | 372 | 338 | 360 | 365 | 350 |
| | POST-IMPREGNATION (g) | 420 | 375 | 375 | 402 | 362 | 390 | 391 | 379 |
| | IMPREGNATION QUANTITY (g) | 30 | 27 | 27 | 30 | 24 | 30 | 26 | 29 |
| | POST-DRYING (g) | 404 | 360 | 360 | 388 | 347 | 375 | 375 | 363 |
| POST-DRYING WATER CONTENT AT CENTER (%) | | 3.2 | | 3.1 | | 2.9 | | 2.8 | |

As apparent from Table 1, the water content required of the briquette for use as steelmaking material can be achieved by drying the porous mass for 50 minutes.

Figure 2:
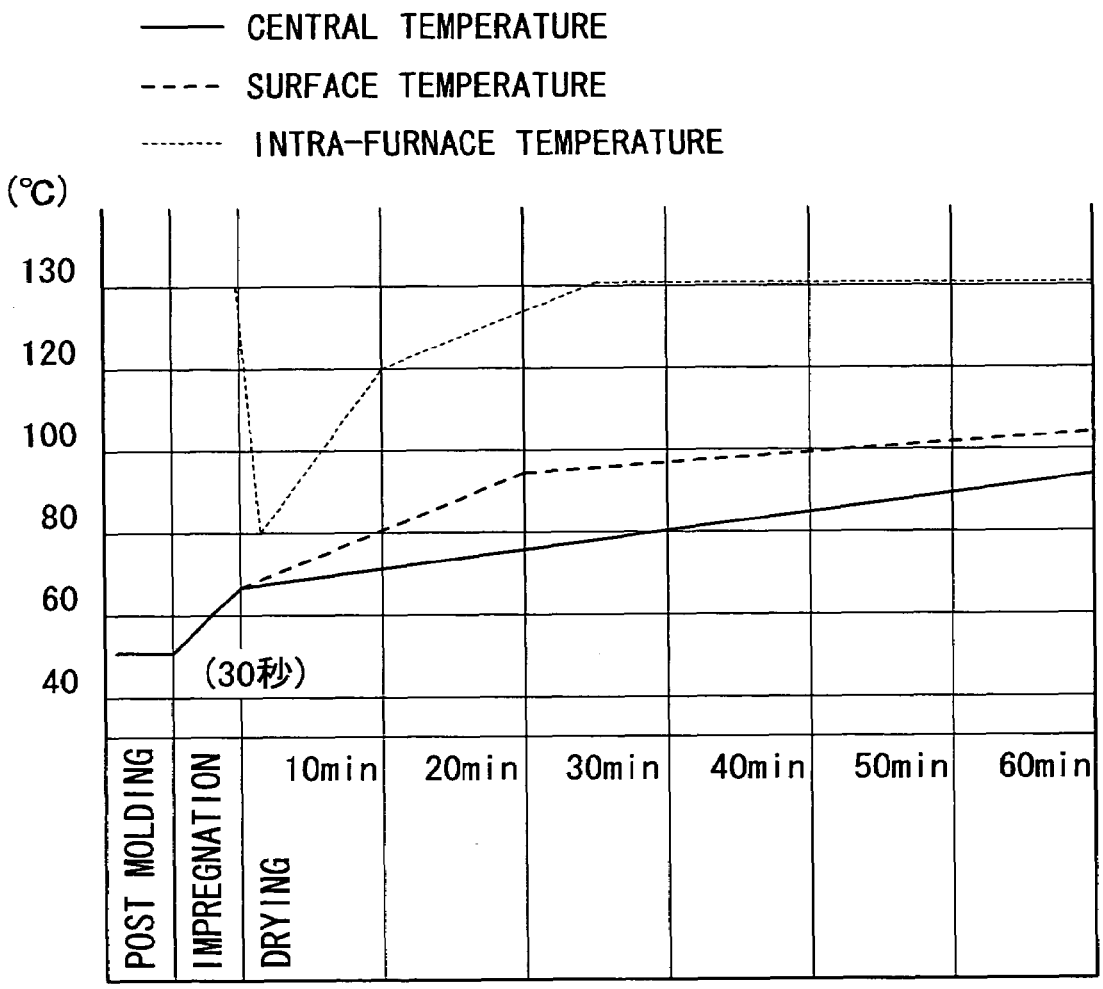
FIG. 2 is a graph showing the moment-to-moment temperature change of a porous mass as determined in an evaluation test.

FIG. 2 is a graph showing the moment-to-moment temperature change of the porous mass as determined in the evaluation test. The graph shows that the just-molded porous mass has a temperature of 50° C. so that the porous mass may be fed into the drying furnace as increased in the temperature by 18° C. or so by the impregnating step.

Figure 3:
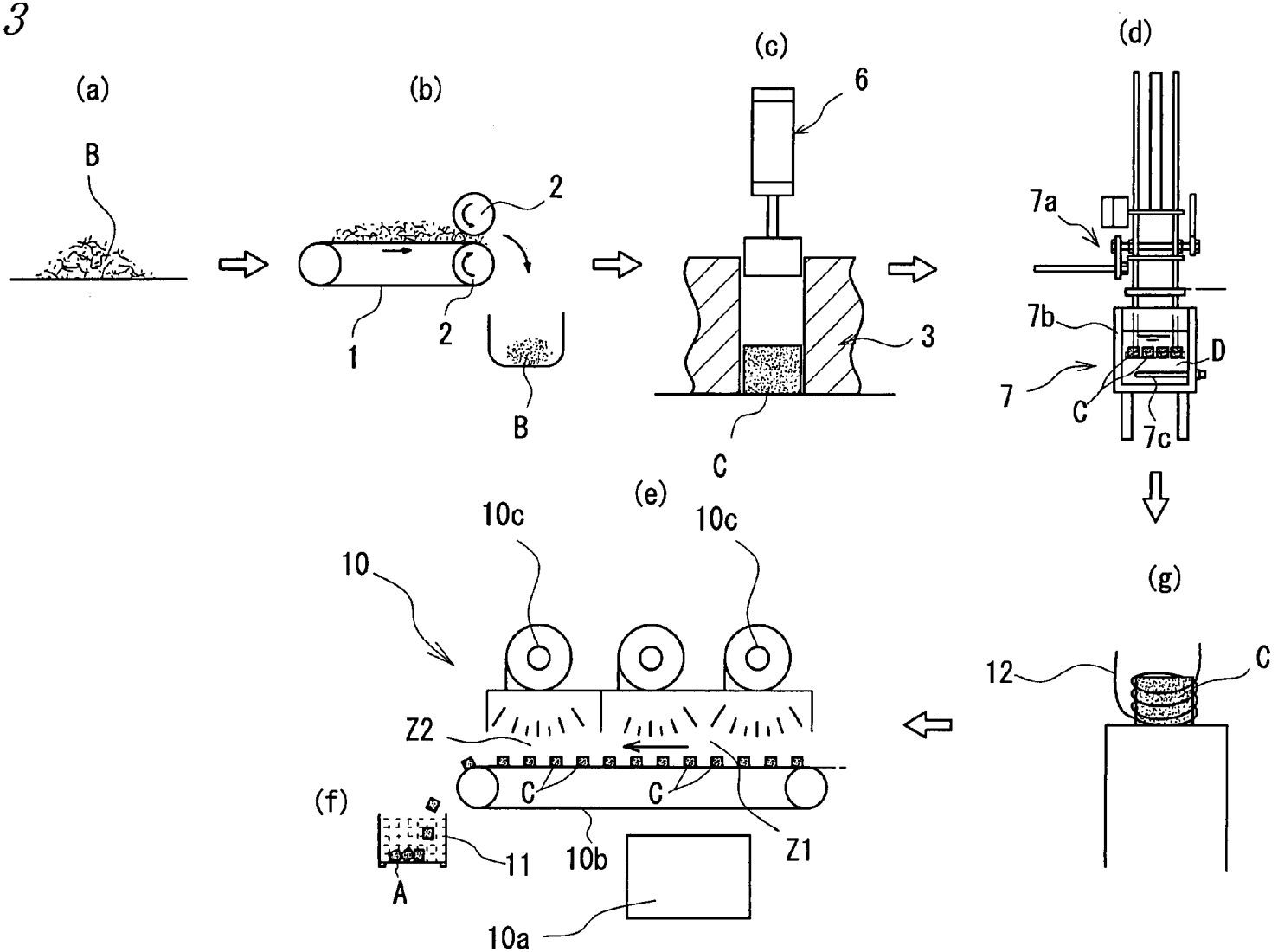
FIG. 3 is a step chart illustrating a manufacturing method of briquette for use as metal stock according to another embodiment of the invention.

FIG. 3 is a step chart illustrating a manufacturing method according to another embodiment of the invention. This embodiment differs from the embodiment shown in FIG. 1 in that this method further includes a preheating step of heating the porous mass C, which is interposed between the impregnating step and the drying step (FIG. 3G). The preheating step is to raise the temperature of the porous mass C to 90° C. to 120° C. by using, for example, a high-frequency induction heater 12 illustrated in the figure, or an IH heater or the like. According to the embodiment, the porous mass C is heated to 90° C. to 120° C. before fed into the drying furnace 10 and hence, the drying time of the porous mass C may be more effectively reduced.

Besides the aforementioned cotton-like aggregates B, the recyclable material may further include shot waste including a powder metal and a large number of shot beads, metal-bearing powder dust occurring in steelmaking/smelting processes or the like, and a mixture of the above. In short, at least one selected from the group consisting of the cotton-like aggregates, the shot waste and the powder dust may be used as the recyclable material.

What is claimed is:

1. A manufacturing method of briquette for use as metal stock comprising:

a molding step of forming a porous mass by compression molding a recyclable material containing a powder metal, wherein the recyclable material is at least one selected from the group consisting of cotton-like aggregates containing iron-based metal grinding dust and a grinding fluid, shot waste including powder metals and a large number of shot beads, and powder dust;

an impregnating step of impregnating the just-molded porous mass with a solidification assistant by dipping the porous mass in the solidification assistant having a higher temperature than the porous mass, wherein the solidification assistant is at least one selected from the group consisting of colloidal silica, sodium silicate, aluminum phosphate and asphalt emulsion; and a drying step of drying the just-impregnated porous mass by heating the porous mass in a drying furnace.

2. A manufacturing method of briquette for use as metal stock according to claim 1, wherein the porous mass is dipped in the solidification assistant for 15 to 180 seconds in the impregnating step.

3. A manufacturing method of briquette for use as metal stock according to claim 1, further comprising a preheating step of heating the porous mass, which step is interposed between the impregnating step and the drying step.

4. A manufacturing method of briquette for use as metal stock according to claim 1, wherein heat including waste heat generated in the drying furnace is supplied to the porous mass carried on a transport path extended from the molding step to the drying step.

5. A manufacturing method of briquette for use as metal stock according to claim 1, wherein the solidification assistant is heated to 80 to 100° C.

* * * * *